United States Patent [19]

Corbach et al.

[11] 4,093,887

[45] June 6, 1978

[54] SPARK PLUG, PARTICULARLY FOR INTERNAL COMBUSTION ENGINES HAVING COMPOSITE CENTER ELECTRODE

[75] Inventors: Rainer Corbach, Stuttgart; Leo Steinke, Waiblingen-Hegnach; Walter Benedikt, Stuttgart; Rudolf Jurinke, Schwieberdingen, all of Germany

[73] Assignee: Robert Bosch GmbH, Stuttgart, Germany

[21] Appl. No.: 738,936

[22] Filed: Nov. 4, 1976

[30] Foreign Application Priority Data

Nov. 7, 1975 Germany ..... 2549931

[51] Int. Cl.[2] ..... H01T 13/20

[52] U.S. Cl. ..... 313/140; 29/25.14; 313/11.5; 313/141

[58] Field of Search ..... 313/141, 142, 11.5, 313/309, 140; 123/169 EL, 169 E; 29/25.12, 25.14

[56] References Cited

U.S. PATENT DOCUMENTS

| | | | |
|---|---|---|---|
| 2,296,033 | 9/1942 | Heller | 313/141 X |
| 2,470,033 | 5/1949 | Hensel | 313/142 |
| 2,783,409 | 2/1957 | McDougal | 313/141 |
| 2,835,726 | 5/1958 | Beesch | 313/136 X |
| 3,356,882 | 12/1967 | Hallauer et al. | 313/141 |

FOREIGN PATENT DOCUMENTS

| | | | |
|---|---|---|---|
| 2,361,274 | 6/1975 | Germany | 313/141 |
| 566,633 | 12/1932 | Germany | 313/141 |

*Primary Examiner*—Siegfried H. Grimm
*Attorney, Agent, or Firm*—Flynn & Frishauf

[57] ABSTRACT

The spark plug center electrode is a composite of a jacket of corrosion resistant material, central filamentary core electrode elements, likewise of corrosion resistant material, and a matrix of thermally and electrically highly conductive material in which the corrosion resistant filamentary elements are embedded, filling the electrode within the outer jacket; in accordance with the present invention, the matrix material is recessed with respect to the jacket and the sparking ends of the corrosion resistant filamentary material to increase lifetime and to provide protection for the electrically and thermally highly conductive material and ensure ignition of even comparatively lean fuel-air mixtures. The electrode has an overall diameter in the order of about 2.4 mm, the recess of the matrix material being between 50 to 500 $\mu$ m, preferably about 100 to 250 $\mu$ m; a platinum coating having a thickness of preferably between 40 and 50 $\mu$ m can be provided to cover the exposed end of the electrode. The recess can be effected by etching selective to the matrix material and not attacking the corrosion resistant jacket and filamentary elements.

13 Claims, 4 Drawing Figures

SPARK PLUG, PARTICULARLY FOR INTERNAL COMBUSTION ENGINES HAVING COMPOSITE CENTER ELECTRODE

CROSS REFERENCE TO RELATED APPLICATIONS

Ser. No. 608,280 filed Aug. 27, 1975, Wiedenmann et al.

Ser. No. 682,060 filed Apr. 30, 1976, Benedict et al.

U.S. Pat. No. 3,144,576 assigned to the assignee of the present application.

The present invention relates to electrical spark plugs, and more particularly to spark plugs for internal combustion engines and to the center electrode thereof.

Spark plugs have been proposed—see cross-referenced applications—in which a center electrode is formed as a composite element consisting of a matrix material of high conductivity for electricity and heat in which a plurality of filamentary elements are embedded extending longitudinally of the electrode and made of a material which is highly corrosion resistant and, additionally, also has good conductivity with respect to electricity and heat. A jacket of highly corrosion resistant material surrounds the composite core of matrix and filament or filaments. As few as one single filament and as many as 200 may be embedded in the matrix material; a suitable, preferred number is, for example, seven longitudinally extending filaments.

The self-cleaning or self-combusting temperature which the spark plug must reach in order to burn off soot, carbon deposits, oil and carbonized oil on the insulator of the spark plug is about 500° C. Spark plugs used with engines of low power require a long central insulator so that the spark plugs will reach the self-cleaning temperature. Unless carbon deposits and the like are burned off the insulator, spurious short circuits and creep paths may occur between the center electrode and the housing or socket for the spark plug which is connected to motor chassis, thus detracting for sparking energy. Use of long central insulators, however, requires that the heat which arises due to the combustion of the fuel-air mixture in the motor and which heats the spark plug, can be suitably conducted off the spark plug; otherwise, long sleeves have the tendency to cause spurious combustion of fuel-air mixtures in the engine since long, central insulators have the tendency to cause such spurious ignition by incandescence, beyond control of the electrical sparking energy itself. In order to improve the spark plug, multi-element central electrodes were developed. They include, as set forth specifically in the cross-referenced applications, a jacket of a material which is resistant against corrosion of the hot combustion gases surrounding a material having excellent heat conductivity and, preferably, also excellent electrical conductivity. A typical material for the jacket is nickel; a typical material for the matrix or filler or core material is copper. It has also been proposed—see the aforementioned cross-referenced applications—to use a core which itself is a composite, including a matrix material of high electrical and thermal conductivity in which filaments are embedded having high corrosion resistance and preferably also good electrical and thermal conductivity. The filaments may, for example, be nickel or nickel base material, and may in one embodiment be similar to the material used for the outer jacket.

It is an object of the present invention to improve a spark plug of the type having a jacket surrounding a composite core which has improved life, improved operating reliability, and which additionally can be efficiently manufactured as an article of mass production with low rejects and uniformity of the product. Operating reliability is particularly important in order to ensure ignition of fuel-air mixtures which are lean, while using low ignition voltages. As an ancillary object, the spark plug should have an electrode which can be easily manufactured and universally used for many types of spark plugs, particularly for spark plugs of premium and extended life quality.

SUBJECT MATTER OF THE PRESENT INVENTION

Briefly, the matrix material of the composite center electrode of the spark plug is recessed with respect to the jacket and preferably also with respect to the embedded filamentary elements. In accordance with a preferred feature, the recess of the matrix material of the electrode behind the surface or end face plane of the electrode is in the order of between 50 to 500 $\mu$ m, preferably about 100 to 250 $\mu$ m.

Electrodes of this type used in spark plugs of extended lifetime or premium quality are coated with a platinum coating at the ignition end of the electrode. The platinum coating then will cover the matrix material, the filamentary elements and the area at and immediately surrounding the end surface of the jacket. The thickness of this platinum coating is in the range of between 10 to 100 $\mu$ m, preferably in the range of about 40 to 50 $\mu$ m.

In a preferred embodiment, the matrix material of the electrode is copper or a copper base alloy, preferably a corrosion resistant copper base alloy; the jacket as well as the filamentary elements are made of a material based on nickel, chromium or cobalt. The matrix material made of copper or copper base alloy is normally between 5 and 50%, preferably about between 20 and 40%, by volume, of the electrode. The number of filamentary elements of corrosion resistant material in the matrix normally can extend to about 21, preferably, however, will be only seven filaments. In a preferred form, the filamentary elements are distributed essentially uniformly throughout the cross section of the matrix material without having mutual contact, that is, are wholly surrounded by matrix material.

The invention will be described by way of example with reference to the accompanying drawings, wherein.

Figure 1:
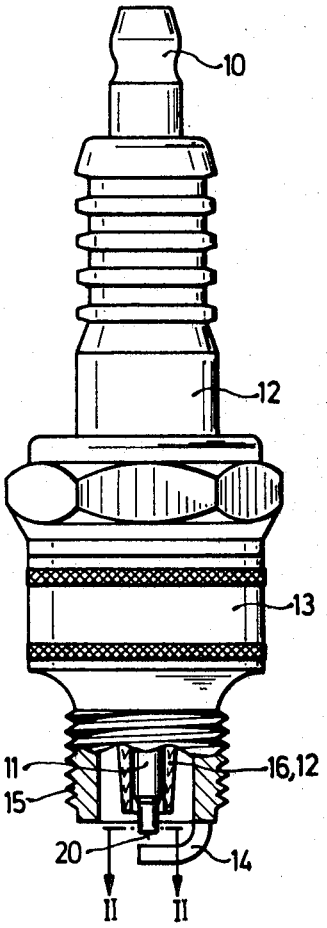
FIG. 1 is a side view, partly in section, of a spark plug having the composite center electrode, and drawn to an enlarged scale.

The construction of the spark plug body of FIG. 1 is essentially conventional; an electrical terminal 10 is electrically connected to center electrode 11. The terminal 10 and the center electrode 11 are separated from the outer housing or socket 13 by an insulator 12. The socket 13 terminates in the ground or chassis electrode 14 and is formed with a threaded end 15 to secure the spark plug in the motor block of an internal combustion engine, not shown. The terminal portion of the insulator 12 will be termed the insulator sleeve 16. The insulator 12 is a unitary element which, including its sleeve 16, is a ceramic body made of a material based on aluminum oxide with additives of glazing substances in order to give it high mechanical strength. The insulator is made in special furnaces. The insulator and the housing are made in accordance with well known technology.

Figure 2:
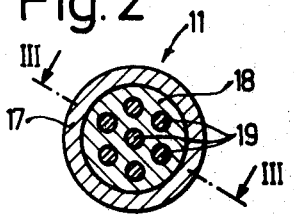
FIG. 2 is a cross-sectional view along line II—II of FIG. 1.

The center electrode 11, as best seen in FIG. 2, has an outside diameter (OD) of about 2.4 mm. It consists of a jacket 17 having a wall thickness of about 0.35 mm. This jacket 17 is made of a material which is especially resistant to corrosion by the hot combustion gases occurring in internal combustion engines. The preferred material is nickel or a nickel base alloy, and it may also be made of a material based on chromium or cobalt. Jacket 17 surrounds a matrix material 18. Matrix material 18 has the characteristic that it is of high electrical conductivity and high thermal conductivity. Matrix material 18 is a copper base alloy or, preferably, essentially copper. The matrix 18 has embedded therein seven filaments 19 which, preferably, are made of essentially the same material as that of the jacket 17. The proportion of copper as matrix material 18 in the electrode 11, overall, is about 30% by volume; other embodiments according to this invention may have a copper content varying between 5 and 50% by volume. As described, the preferred electrode 11 has seven filaments 19 embedded in the matrix 18; customary spark plugs, depending upon use and the type of engine with which they are to be associated may have between one and 21 filaments 19, however; up to 200 filaments can be embedded in the matrix material 18 for special applications. The filaments 19 in the embodiment shown in FIG. 2 have a diameter of about 0.3 mm and are so arranged—as shown in FIG. 2—that they are distributed essentially uniformly over the cross section of the matrix material 18 and are so placed that they do not touch each other. The thickness of the filaments 19 has to be suitably selected to accommodate them within the matrix 18; as the number of the filaments 19 increases, the thickness of the filaments 19 must decrease. Filaments 19 are provided to reduce or eliminate corrosion of the matrix material 18 of the electrode and to maintain the distance between the center electrode 11 and the ground or chassis electrode 14 at a fixed level. Further, the electrode is so arranged that the ignition voltage requirement of the spark plug, overall, is held to a low level to ensure reliable ignition of even lean fuel-air mixtures supplied to the engine. If the number of filaments 19 in matrix material 18 increases, the cost to manufacture such a composite electrode increases rather rapidly. If the filaments 19 touch each other, the danger of corrosion within the electrode 11 is increased. For spark plugs of application in the usual type of automotive internal combustion engine, seven filaments distributed as shown in FIG. 2 are a preferred form.

Figure 3:
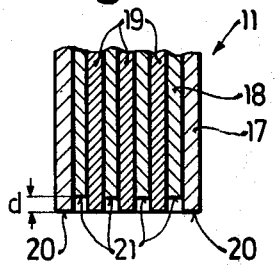
FIG. 3 is a cross section along line III—III of FIG. 2.

In accordance with the present invention, the matrix material 18 is recessed behind the plane forming the end face of the electrode 11, as best seen in FIG. 3. The electrode end surface plane 20, which is not covered by nickel but leaves exposed the end of the composite of matrix material and filaments, is so treated that the matrix material 18 is recessed by a dimension *d* behind the end plane 20. The recess of surface 21 with respect to surface 20, dimension *d*, is in the order of about 200 $\mu$ m; in other embodiments of such automotive-type spark plugs, the dimension *d* may vary between about 50 to 500 $\mu$ m, depending on the type of engine and the application thereof. Copper, used as matrix material 18, and which, as well known, corrodes under the influence of the hot combustion gases then, with the filaments 19 embedded therein, reliably resists the attack by the hot combustion gases.

The matrix material 18 can be removed from the end surface 20 of the center electrode 11 by mechanical or electrical means; for example, spraying or impinging steel grains against the end face 20 of an electrode will remove the softer copper but leave the jacket 17 and filaments 19. Preferably, the matrix material 18 is, however, removed chemically, or electrochemically by being etched away until the surface 21 of matrix 18 has the desired recess depth *d* with respect to the end plane 20.

The copper of matrix material 18 can be dissolved or etched out from the center electrode 11 by a 5% ammonia solution to which an oxidation substance is added, for example about 1 to 40% ammonia persulfate, or about 1 to 15% hydrogen peroxide. Copper can also be dissolved by means of mineral acids, such as hydrochloric acid or sulfuric acid in the range of from about 5% to highly concentrated. The acids additionally contain oxidation additives, as above described, or chromate to about 60%. Copper can also be dissolved out by oxidizing acids, such as for example $HNO_3$, to 10% concentrated; $HNO_3$/HCl mixture 1:5 to 5:1; acidic chromate solutions.

The previously described processes dissolve out the matrix material 18 chemically, to recess matrix material 18 to have an end surface 21, recessed behind the end face plane 20 of the electrode by the required distance *d*. The matrix material 18 can also be removed electrochemically or chemically by using salt solutions to dissolve the copper of matrix material 18 by anodic electrochemical treatment, at ambient room temperature up to boiling temperature of the solution:

$FeCl_3$ solution (of 5 to 70%)
$CuCl_2$ solution (of 5 to 50%)
$NaNO_3$ solution (of 5 to 50%)
$KNO_3$ solution (of 5 to 50%)
$NH_4NO_3$ solution (of 5 to 50%)
KCN solution (of 5 to 50%)
NaCN solution (of 5 to 50%).

The foregoing salt solutions additionally may contain oxidation additives such as, for example, hydrogen peroxide, $H_2O_2$, of about 1 to 10%.

Figure 4:
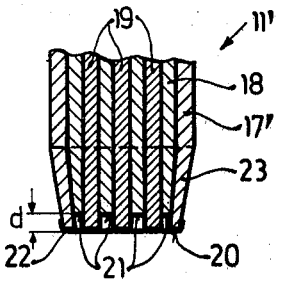
FIG. 4 is a cross-sectional view corresponding to the section line III—III but illustrating another embodiment of the center electrode of the spark plug.

The physical shape of the electrodes 11, 11' may have different forms. As illustrated in the embodiment of FIG. 4, the outside jacket can be slightly tapered. FIG. 4 shows, overall, an electrode used for spark plugs of extended lifetime. Electrode 11' has a cross section which generally is similar to the cross section of FIG. 2 of electrode 11. The end surface, and the adjacent surrounding region of the jacket 17', however, are covered with a platinum layer 22. This platinum layer 22 coats the entire exposed surfaces, that is, extends around the end surface of the jacket material 17', the surface 21 of the matrix material 18 and the side and end surfaces to the end face plane 20 of the filamentary elements 19. The thickness of the platinum cover 22, in the preferred form, is in the order of about 50 $\mu$ m; this is not a fixed thickness, however, and the platinum coating may vary in other embodiments of such automotive-type spark plugs, depending on application, between 10 to 100 $\mu$ m. The jacket 17' tapers in thickness towards the end face plane 22. This improves the accessibility of the electrodes 11' and 14 to the fuel-air mixture and reduces the requirement for platinum of the platinum coating 22. The tapered portion 22 is essentially frusto-conical, as seen in FIG. 4. The matrix material 18 is, of course, recessed by the dimension *d* as described in accordance with FIG. 3, the dimension *d* in FIG. 4 being taken between the outer exposed surfaces of the end faces 20 and 21, including the platinum coating.

Various changes and modifications may be made, and features described in connection with any one of the embodiments may be used with any of the others, within the scope of the inventive concept.

We claim:

1. Spark plug having a center electrode formed with a sparking end face comprising an outer jacket (17, 17') of corrosion resistant material;

an embedding matrix material (18) of high electrical and thermal conductivity within the jacket (17, 17');

and at least one filamentary electrode element (19) of corrosion resistant material embedded in the matrix material (18), wherein, in accordance with the invention, the matrix material (18) is recessed with respect to the jacket (17, 17') at the sparking end face plane (20) of the spark plug, the distance of recess (*d*) being in the order of between about 50 to 500 μm.

2. Spark plug according to claim 1, wherein the at least one filamentary electrode (19) terminates approximately flush with the outer jacket (17) and the matrix material is recessed with respect to both the outer jacket (17) and said at least one filamentary electrode (19).

3. Spark plug according to claim 1, wherein the distance of recess is in the order of about 100 to 250 μm.

4. Spark plug according to claim 1, wherein the material of the matrix (18) consists of a material selected from the group of at least one of: copper; copper alloy; a corrosion resistant copper base alloy;

and the material of the jacket (17) and of the at least one filamentary electrode element (19) consists of at least one of: a nickel base alloy; a chromium base alloy; a cobalt base alloy.

5. Spark plug according to claim 4, wherein the electrode (11) comprises, by volume, about between 5 to 50% of matrix material (18).

6. Spark plug according to claim 5, wherein the matrix material (18) is between about 20 to 40%, by volume.

7. Spark plug according to claim 1, wherein said at least one filamentary electrode element (19) comprises up to about 21 filamentary elements (19), the filamentary elements being essentially uniformly distributed throughout the cross section of the matrix material (18) and are placed in essentially non-contacting relation with respect to each other to be essentially wholly surrounded by the matrix material (18).

8. Spark plug according to claim 7, wherein seven filamentary electrode elements (19) are provided, the filamentary elements terminating approximately flush with the outer sparking end face plane (20) of the jacket (17), and the matrix material is recessed with respect to both the jacket (17) and said filamentary electrodes (19) by a distance of between about 100 to 250 μm, the matrix material consisting of a material selected from the group of: copper, copper base alloy; corrosion resistant copper alloy;

and the jacket (17) as well as the filamentary electrode elements (19) consists of a material selected from the group of: nickel base, chromium base, cobalt base; the matrix material being present in the range of about between 20 to 40% by volume.

9. Spark plug according to claim 1, wherein the outer jacket (17) is formed with a frusto-conical portion (23) adjacent the end face plane (20) of the electrode whereby the wall thickness of the outer jacket (17') tapers and decreases towards the end face plane (20).

10. Spark plug according to claim 4, wherein the outer jacket (17) is formed with a frusto-conical portion (23) adjacent the end face plane (20) of the electrode whereby the wall thickness of the outer jacket (17') tapers and decreases towards the end face plane (20).

11. Spark plug according to claim 1 wherein the matrix material consists of at least one of: copper; a corrosion resistant copper alloy; a copper base alloy, the matrix material forming between 5 and 50%, by volume, of the electrode;

and the jacket is essentially a cylindrical cover extending around the outer circumference of the matrix material leaving an exposed end face of said at least one filamentary electrode element (19) of corrosion resistant material embedded in said matrix material;

and a counter electrode (14) opposite of and facing said exposed end face.

12. Spark plug according to claim 11 wherein the matrix material (18) is between about 20 to 40%, by volume, and the distance of recess (*d*) is in the order of about 100 to 250 μm.

13. Spark plug according to claim 12 wherein the at least one filamentary electrode element (19) terminates approximately flush with the outer jacket (17) and the matrix material facing said counter electrode (14) is recessed with respect to both the outer jacket (17) and said at least one filamentary electrode element (19).

* * * * *